United States Patent [19]

Elmore

[11] 4,134,268

[45] Jan. 16, 1979

[54] DRAINAGE FIELD PIPE

[75] Inventor: John E. Elmore, Oak Hill, W. Va.

[73] Assignees: Jack G. Elmore; H. P. Thomas, Jr., both of Oak Hill, W. Va.

[21] Appl. No.: 839,834

[22] Filed: Oct. 6, 1977

[51] Int. Cl.[2] ..... E02B 11/10

[52] U.S. Cl. ..... 405/43

[58] Field of Search ..... 61/13, 12, 11, 10; 210/170, 165

[56] References Cited

U.S. PATENT DOCUMENTS

| | | | |
|---|---|---|---|
| 2,436,630 | 2/1948 | Clegg | 210/170 |
| 3,374,634 | 3/1968 | Fochler | 61/10 |
| 3,753,352 | 8/1973 | McNally | 61/11 X |
| 4,061,272 | 12/1977 | Winston | 61/13 |

FOREIGN PATENT DOCUMENTS

| | | | |
|---|---|---|---|
| 406990 | 8/1966 | Switzerland | 61/11 |
| 15555 of | 1898 | United Kingdom | 61/11 |

*Primary Examiner*—Jacob Shapiro

[57] ABSTRACT

An improved drainage field pipe is disclosed which is a cylindrical tube of substantially circular cross section composed of an organic polymer material, having a principal axis slightly inclined with respect to the horizontal, for conducting a fluid slurry containing solid particles from a source connected to the inlet thereof, to be dispersed along the lower side of the tube into a subterranean drainage trench lined with crushed rock. A plurality of slots perforate the tube along the lower side thereof, with each slot having its length dimension greater than its width dimension. The slots allow the solid particles from the fluid slurry to pass out of the tube into the drainage trench while preventing the crushed rock from passing from the drainage trench into the tube.

4 Claims, 8 Drawing Figures

SEC A-A'

SEC B-B'

SEC C-C'

SEC D-D'

DRAINAGE FIELD PIPE

FIELD OF THE INVENTION

The invention disclosed broadly relates to fluid conducting pipes and more particularly relates to pipes suitable for dispersing a fluid into a drainage trench.

BACKGROUND OF THE INVENTION

The predominant type of domestic, private sewage disposal system is the septic tank and drainage field. Waste from the house flows into a water tight septic tank. There it remains for approximately 24 hours while bacteria reduce many of the solids to a liquid state. At the end of this interval, the liquid flows out of the tank into a leaching field through a network of porous pipes. These porous pipes are placed fairly close to the ground surface, which allows air to get to the liquids and evaporate them before they have a chance to drain off into the ground water.

It has been found that although most of the solids contained in the sewage slurry are biodegradable, a substantial portion of these solids are not decomposed within the approximately 24 hour period that a given volume of the slurry remains in the septic tank. Thus the longer term biodegradable solid components of the slurry which flow out of the septic tank into the network of porous pipes, will begin to accumulate therein if their rate of production in the sewage system is greater than their rate of disintegration.

The early prior art in septic tank drainage field construction employed one foot lengths of vitrified clay tile pipe which were laid end-to-end with one inch separations therebetween, in a drainage ditch lined with crushed rock. Asbestos shingles or tar paper would then be placed over the one inch wide gap between adjacent clay tiles to enable the sewage slurry to seep therethrough without admitting the crushed rock lining the drainage trench to enter into the tile interior. This early prior art system worked well, allowing larger non-degraded solids such as non-degraded tissue paper to pass out of the drainage tiles while excluding the admission of the crushed rocks lining the drainage trench into the clay tile interior.

More recently, however, the use of vitrified clay tile in septic tank drainage field construction, has been replaced by the use of less expensive plastic pipe having circular holes axially displaced along the bottom thereof to accomplish the fluid distribution function. It has been found, however, that the larger solid components of the sewage slurry will not pass through the circular holes in the prior art plastic drainage pipe. Simply enlarging the circular holes will lead to an alternate problem of admitting the crushed rock which lines a drainage trench, into the interior of the plastic pipe thereby further clogging it.

OBJECTS OF THE INVENTION

It is therefore an object of the invention to provide an improved drainage pipe.

It is another object of the invention to provide an improved drainage pipe for a septic tank drainage field which allows larger solid particles from the sewage slurry to pass out of the tube while preventing crushed rock from passing from the drainage trench into the tube.

It is yet another object of the invention to provide low cost drainage pipe which has a reduced tendancy to clog.

SUMMARY OF THE INVENTION

These and other objects, features and advantages of the invention are accomplished by the improved drainage field pipe disclosed herein.

An improved drainage field pipe is disclosed which is a cylindrical tube of substantially circular cross section composed of an organic polymer material, having a principal axis slightly inclined with respect to the horizontal, for conducting a fluid slurry containing solid particles from a source connected to the inlet thereof, to be dispersed along the lower side of the tube into a subterranean drainage trench lined with crushed rock. A plurality of slots perforate the tube along the lower side thereof, with each slot having its length dimension greater than its width dimension. The slots allow the solid particles from the fluid slurry to pass out of the tube into the drainage trench while preventing the crushed rock from passing from the drainage trench into the tube. The resulting improved drainage field pipe provides a low cost drainage means which has a reduced tendancy to clog.

DESCRIPTION OF THE FIGURES

These and other objects, features and advantages of the invention will be more particularly appreciated with reference to the accompanying figures.

DISCUSSION OF THE PREFERRED EMBODIMENT

Figure 1A:
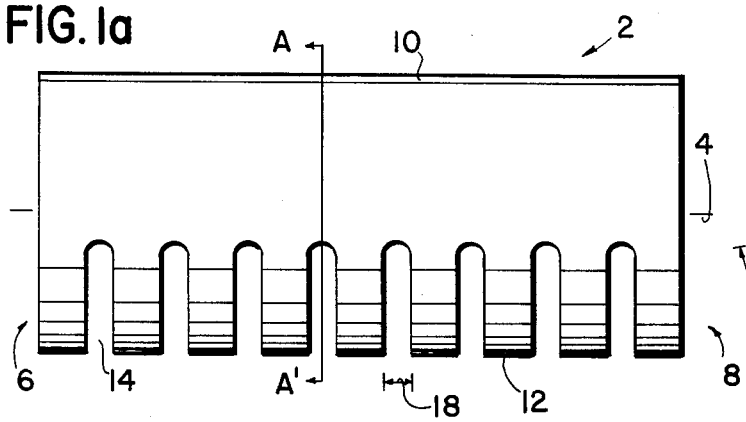
FIG. 1*a* is a side view of a first embodiment of the invention.

Four different embodiments of the improved drainage field pipe are shown in FIGS. 1*a*, 1*b* through 4*a*, 4*b*. FIG. 1*a* shows a first embodiment of the improved drainage field pipe wherein a cylindrical tube 2 has a substantially circular cross section having a principal axis 4 slightly inclined with respect to the horizontal at a grade of approximately one inch per 20 inches. The tube 2 has an inlet end 6, an outlet end 8, an upper side 10 and the lower side 12. The tube conducts the sewage slurry containing solid particles including undecomposed fecal material, bathroom tissue, and other biodegradable solids having a relatively slow rate of degradation, from the septic tank source which is connected to the inlet end 6 to a subterranean drainage trench lined with crushed rock, within which the tube is buried. The sewage slurry is to be dispersed along the lower side 12 of the tube 2 into the drainage trench.

Figure 1B:
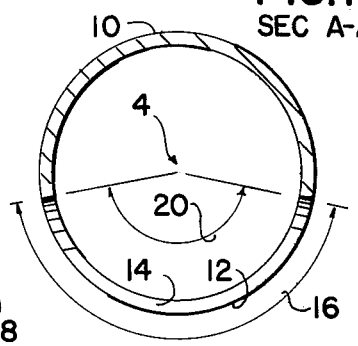
FIG. 1*b* is a cross sectional view along section A–A' of FIG. 1*a*.

A plurality of slots 14 perforate the wall of the tube 2 along the lower side 12 thereof. Each slot 14 has its length dimension 16 greater than its width dimension 18. The slots are shaped so as to allow the solid particles from the sewage slurry to pass out of the tube 2 into the drainage trench while at the same time preventing the crushed rock from passing from the drainage trench into the interior of the tube 2. As is shown in FIGS. 1*a* and 1*b*, slots 14 are oriented with their length dimension 16 perpendicular to the principal axis 4. It has been found the length dimension 16 of each of the slots 14 which lie along a circular arc 16 on the lower side 12 of the tube 2, must intersect an angle 20 from the principal axis 4 of less than 180°. This limitation to the length dimension of the slot 14 allows sufficient wall material to remain for the upper side 10 of the tube 2 so as to impart sufficient structural strength to the tube, while at the same time enlarging the orifice through which the sewage slurry seeps into the surrounding crushed rock, so as to be large enough to pass the undecomposed solid components thereof. In addition, it has been found that the width dimension 18 of each slot 14 in the tube 2 must not exceed the average cross sectional dimension of the crushed rocks surrounding the tube 2 in the drainage trench. The conventional building practice for septic tank drainage trenches employs crushed rocks having an average particle size of approximately one inch and therefore the width dimension 18 of the slots 14 in the tube 2 should not exceed approximately one inch, in order to prevent the rock from entering into the interior of the tube. The preferred diameter of the septic field drainage pipe is approximately four inches.

The tube 2 is composed of an organic polymer material. The organic polymer material may be any of the conventional plastic or rubber compositions employed for drainage pipe and may include fluorocarbon resins such as polytetrafluoroethylene, a polyamide resin such as nylon-66, polyacetal resin, polysulfone resin, polycarbonate resin, polyethylene, a polyester resin such as an epoxy resin, a polyimide resin, polypropylene, a polystyrene resin such as acrylonitrile-butadiene-styrene (ABS), a polyurethane resin, a polyvinyl resin such as polyvinyl chloride, or natural or a synethetic rubber.

Two organic polymer materials are preferred as the composition for the tube 2. The first is a tough rigid thermoplastic, acrylonitrile-butadiene-styrene (ABS) resin and the second is polyvinyl chloride (PVC) resin. ABS resins used in plastic sanitary pipe, are true graft polymers consisting of an elastomeric polybutadiene or rubber phase, grafted with styrene and acrylonitrile monomers for compatibility dispersed in a rigid styrene-acrylonitrile matrix. ABS plastic sanitary pipe has a high impact resistance, a high mechanical strength, and resistance to creep under load. This desirable combination of properties is retained over a temperature range of minus 40 to 140 degrees Fahrenheit with little change. ABS resins exhibit resistance to chemical attack by water, aqueous salt solutions, alkalies, nonoxidizing inorganic acids, many food stuffs and household cleaners and oils. ABS plastic sanitary pipes may be joined by means of solvent welding using a solvent such as butanone. The other preferred organic polymer material, PVC resin, can be formed as a rigid structural material which has a high resistance to chemicals, solvents and water. PVC plastic sanitary pipe has a good resistance to weathering, is low in cost and has a good abrasion and impact resistance.

The inlet end 6 of each tube 2 may have an enlarged diameter with respect to the diameter of the rest of the pipe 2 to enable a male-female coupling with preceeding and succeeding tubes 2 in the distribution system. The tubes may be solvent welded or joined by other conventional means.

Figure 2A:
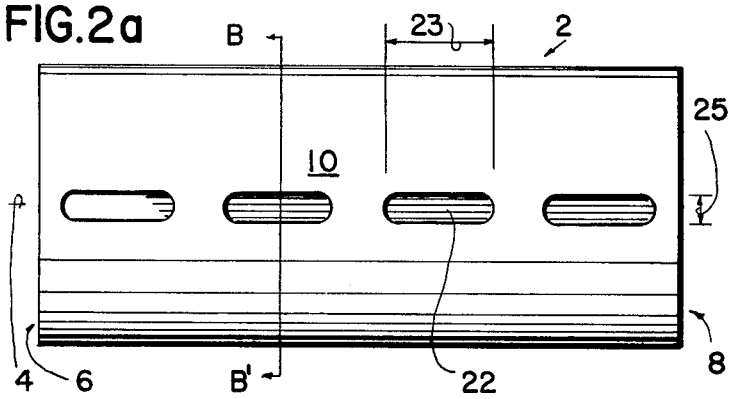
FIG. 2*a* is a bottom view of a second embodiment of the invention.
Figure 2B:
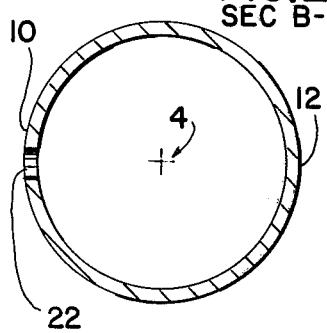
FIG. 2*b* is a cross sectional view along the line B–B' of FIG. 2*a*.

FIGS. 2*a* and 2*b* illustrate an alternate embodiment of the invention where the plurality of slots 22 are oriented with their length dimension 23 parallel to the principal axis 4. In FIG. 2*a* it is seen that the slots 22 form a single row parallel with the principal axis 4. This configuration may be suitable for the drainage of water pumped by a sump pump from the basement of a house, as well as for a distribution tile in a septic tank system. The slots 22 in FIG. 2 have their length dimension 23 equal to approximately 6 inches and their width dimension 25 equal to approximately one inch for a tube 2 having an external diameter of approximately 4 inches. This combination of dimensions has been found optimum for the most efficient drainage of a sewage slurry so as to minimize clogging by the solid components of the slurry while at the same time minimizing the introduction of crushed rock from the surrounding drainage trench into the interior of the tube 2.

Figure 3A:
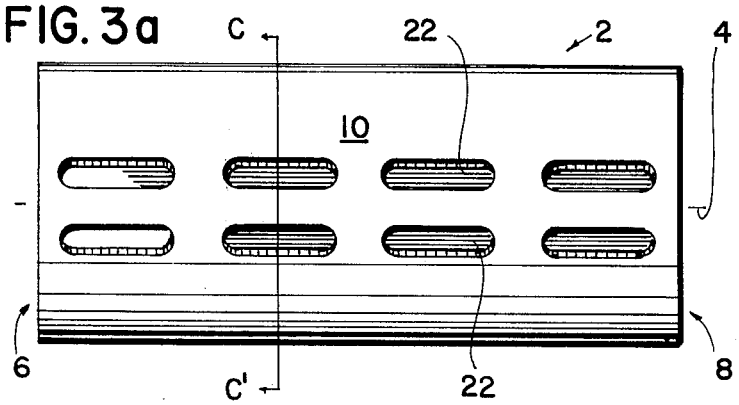
FIG. 3*a* is a bottom view of a third embodiment of the invention.
Figure 3B:
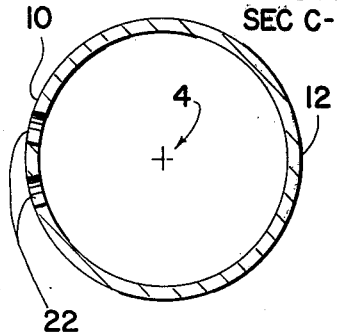
FIG. 3*b* is a cross sectional view along the line C–C' of FIG. 3*a*.

FIG. 3*a* shows a third alternate embodiment and FIG. 3*b* shows a cross section thereof, wherein the slots 22 are oriented with their length dimension 23 parallel to the principal axis 4, forming two mutually parallel rows which are parallel with the principal axis 4. The slots 22 have their length dimension 23 equal to approximately six inches and their width dimension 25 equal to approximately one inch.

Figure 4A:
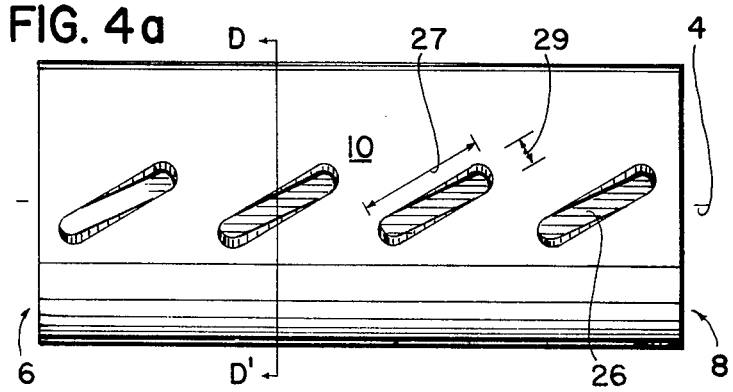
FIG. 4*a* is a bottom view of a fourth embodiment of the invention.
Figure 4B:
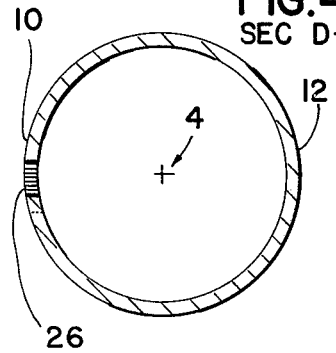
FIG. 4*b* is a cross sectional view along line D–D' of FIG. 4*a*.

FIGS. 4*a* and 4*b* show still a fourth alternate embodiment of the invention wherein the plurality of slots 26 are oriented with their length dimension 27 having an acute angle with respect to the principal axis 4. The slots 26 have their length dimension 27 equal to approximately six inches and their width dimension 29 equal to approximately one inch.

The novel arrangement of the slots in the tube 2 allows the solid particles from the sewage slurry to pass out of the tube into the drainage trench thereby avoiding the accumulated build-up of undisintegrated solids within the pipe, while at the same time preventing the crushed rock within which the pipe is buried, from passing from the drainage trench into the interior of the tube. The improved drainage field pipe provides a low cost, effective means for achieving a low maintenance septic tank drainage field system having a reduced tendancy to clog after long periods of usage.

Although specific embodiments of the inventive concept have been disclosed for illustrative purposes, it will be understood by those skilled in the art that certain changes in the form and detail of the disclosed embodiments may be made thereto without departing from the spirit and scope of the invention.

I claim:

1. An improved drainage field pipe, comprising:

a cylindrical tube of substantially circular cross section having a principal axis slightly inclined with respect to the horizontal, an inlet end, an outlet end, an upper side and a lower side, for conducting a fluid slurry containing solid particles from a source connected to said inlet end, to be dispersed along said lower side into a subterranean drainage trench lined with crushed rock;

a plurality of slots through said tube distributed along said lower side thereof, each having their length dimension perpendicular to said principal axis and greater than their width dimension, said width dimension being approximately one inch, said length dimension lying along a circular arc on said lower side of said tube, intersecting an angle from said principal axis of less than but approximately equal to 180°;

whereby said slots allow said solid particles from said fluid slurry to pass out of said tube into said drainage trench while preventing said crushed rock from passing from said drainage trench into said tube while said tube retains its structural strength.

2. The improved drainage field pipe of claim 1, wherein said tube is composed of an organic polymer material.

3. The improved drainage field pipe of claim 2, wherein said organic polymer material is selected from the group consisting of a fluorocarbon resin, a polyamide resin, a polycarbonate resin, polyethylene, a polyester resin, a polyimide resin, polypropylene, a polystyrene resin, a polyurethane resin, a polyvinyl resin and rubber.

4. The improved drainage field pipe of claim 2, wherein said organic polymer material is selected from the group consisting of acrylonitrile-butadiene-styrene and polyvinyl chloride.

* * * * *